US008882020B2

(12) United States Patent
Lupi et al.

(10) Patent No.: US 8,882,020 B2
(45) Date of Patent: Nov. 11, 2014

(54) APPARATUS AND METHOD FOR EXCHANGE OF CORES IN A WINDING MACHINE

(75) Inventors: Giuseppe Lupi, Gallicano (IT); Angelo Torri, Gallicano (IT); Gianluca Giometti, Parezzana (IT)

(73) Assignee: United Converting S.r.l., Piano di Coreglia, Lucca (IT)

( * ) Notice: Subject to any disclaimer, the term of this patent is extended or adjusted under 35 U.S.C. 154(b) by 201 days.

(21) Appl. No.: 13/376,059

(22) PCT Filed: May 24, 2010

(86) PCT No.: PCT/IB2010/001217

§ 371 (c)(1),
(2), (4) Date: Dec. 2, 2011

(87) PCT Pub. No.: WO2010/140035

PCT Pub. Date: Dec. 9, 2010

(65) Prior Publication Data

US 2012/0085856 A1 Apr. 12, 2012

(30) Foreign Application Priority Data

Jun. 5, 2009 (IT) ..... FI2009A0125

(51) Int. Cl.

| | |
|---|---|
| ***B65H 35/08*** | (2006.01) |
| ***B65H 19/26*** | (2006.01) |
| ***B65H 19/22*** | (2006.01) |

(52) U.S. Cl.

CPC ..... *B65H 19/2269* (2013.01); *B65H 19/267* (2013.01)

USPC ..... 242/526.1; 242/532.2; 242/542.1

(58) Field of Classification Search

USPC ..... 242/526.1, 532.2, 532.3, 542, 542.1

See application file for complete search history.

(56) References Cited

U.S. PATENT DOCUMENTS

| | | | | |
|---|---|---|---|---|
| 7,172,151 | B2 * | 2/2007 | Biagiotti et al. | 242/521 |
| 7,404,529 | B2 * | 7/2008 | Biagiotti et al. | 242/521 |
| 8,282,032 | B2 * | 10/2012 | Tsai | 242/532.3 |
| 2006/0076450 | A1 * | 4/2006 | Gelli et al. | 242/526 |
| 2006/0208127 | A1 * | 9/2006 | Tsai | 242/526 |
| 2007/0102561 | A1 * | 5/2007 | Tsai | 242/532.3 |
| 2007/0102562 | A1 * | 5/2007 | Tung-I | 242/533 |
| 2008/0283656 | A1 | 11/2008 | Gelli | |

FOREIGN PATENT DOCUMENTS

| | | | |
|---|---|---|---|
| EP | 0 524 158 | A1 | 1/1993 |
| EP | 1 219 555 | A1 | 7/2002 |
| GB | 2 150 536 | A | 7/1985 |
| WO | 95/10472 | A1 | 4/1995 |
| WO | 2004/005172 | A1 | 1/2004 |

* cited by examiner

*Primary Examiner* — Sang Kim

(74) *Attorney, Agent, or Firm* — McGlew and Tuttle, P.C.

(57) ABSTRACT

A method and an apparatus for exchange of cores in a machine for winding a continuous layer of paper (1) drawn by a drawing assembly (2) and wound around a succession of cores (3) by a winding assembly (4), comprising a step of interruption of the continuity of the layer (1), via a difference of speed of the layer.

14 Claims, 6 Drawing Sheets

APPARATUS AND METHOD FOR EXCHANGE OF CORES IN A WINDING MACHINE

TECHNICAL SECTOR

The invention relates to a method and an apparatus for exchange of the cores of logs being formed in winding machines.

STATE OF THE ART

As is known, generally provided in winding machines are an assembly for drawing a layer of paper fed from a main reel and a winding assembly for winding the layer around a rod or core until a log of paper of the desired diameter or having the required length of paper is formed.

At the end of winding of a log, it is hence necessary to carry out the so-called core exchange, i.e., interrupt continuity of the layer of paper, expel the log that has already been formed, and start up a new process of winding around a new core that has been received by the winding assembly for execution of the next cycle.

For this purpose, there have been known for some time machines that envisage the use of insertion grippers that grip the layer mechanically at the winding assembly advancing at a rate lower than that of the paper and of the top winding roller with which they come into contrast by mechanical interference.

A known machine of this type is described in the document No. EP524158.

This solution presents the drawback that the grippers can wear out as a result of the mechanical contact and that, moreover, there is an impact with a roller of the winding assembly with consequent vibrations and pulsating loads on the supporting bearings of the roller, which can cause irregularities on the layer of paper being wound.

In a similar solution, the grippers are set in interference with a pad instead of with the roller.

Also this solution presents the drawback of the wear of the grippers, and moreover requires a vacuum suction device to withhold the core on the grippers.

PURPOSE OF THE INVENTION

The purpose of the present invention is to overcome the drawbacks of the solutions already known and propose a highly reliable method and apparatus for exchange of cores that drastically limits the negative effects of the operation of exchange on the quality of the layer being formed.

The above purpose has been achieved by providing an apparatus and a method for exchange of cores according to the annexed claims.

A first advantage of the invention consists in the absence of mutually contrasting mechanical parts.

A second advantage lies in the fact that the interruption of the continuity of the layer of paper occurs only by acceleration of the winding assembly without inducing any deceleration of the layer upstream of the core and thus avoiding formation of creases in the paper.

A further advantage lies in the fact that any deceleration in drawing the layer of paper is avoided, with the result of a more uniform winding.

LIST OF THE DRAWINGS

The above and further advantages will be better understood by any person skilled in the branch from the ensuing description and from the annexed plates of drawings, which are provided purely by way of non-limiting example, wherein.

DETAILED DESCRIPTION

Figure 1A:
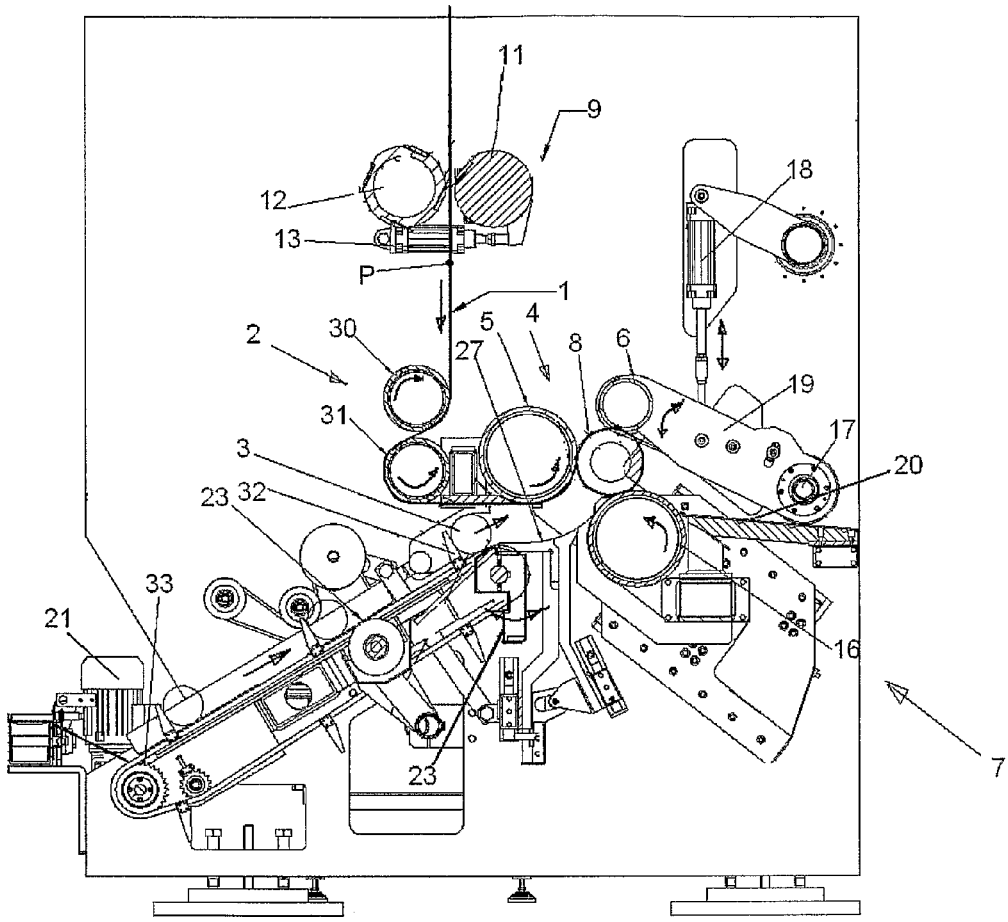
FIG. 1A shows an overall view of a winding machine and of an apparatus for exchange of cores that implements the method according to the invention.

Described with reference to FIG. 1A is a winding machine 7 for the production of logs 8 formed by winding a continuous layer 1 of paper around hollow cylinders 3, or cores, normally made of cardboard.

The layer 1 is fed from a main reel, not illustrated, and passes in succession through a perforating assembly 9 for making upon command transverse perforated lines P, a drawing assembly 2 for advance of the layer 1, and a winding assembly 4 that produces the logs 8 by winding the layer on a succession of cores 3 coming from a supply of cores 10.

In greater detail, the perforating assembly 9 comprises a first, etched, roller 11 and a second, smooth, roller 12, which is mobile so that it approaches the first roller via an actuator 13 so as to incise the layer of paper and make a perforated line P that weakens the continuity of the layer in the appropriate points in order to facilitate subsequent tearing of the layer.

Downstream of the perforating assembly 9, the layer of paper passes between the top and bottom rollers of the drawing assembly 2 (preferably a smooth roller 30 and a rough roller 31), the rate of rotation which determines the rate of advance of the layer 1 through the machine.

Immediately downstream of the drawing assembly, the layer passes through a channel 15 in which a ramp 10 for supplying the cores 3 converges, said ramp 10 comprising mobile brackets 32 drawn by a chain 33, driven by a motor drive 21. Moreover set along the ramp 10 is a gluing assembly 22 for laying along the cores 3 of a strip of glue designed to withhold the initial flap of the layer 1 during subsequent winding.

Once the channel 15 is passed, the layer 1 enters the winding assembly 4, which winds the layer around the core 3 being processed and which comprises a top winding roller 5, a bottom winding roller 16, and a pressure roller 6, all in contact with the log 8 being formed and at least one of which is motor-driven independently of the drawing assembly 2.

In the example described, the pressure roller 6 is carried by an arm 19 that turns about an axis 17 by means of an actuator 18 so as to approach the log 8 upon command and to control the parameters of winding thereof, for example the diameter and softness. Finally, located downstream of the winding assembly is a chute 20 for expulsion of the finished log 8.

With reference to FIGS. 1 to 6, operation of the winding machine 7 is now illustrated.

Figure 1:
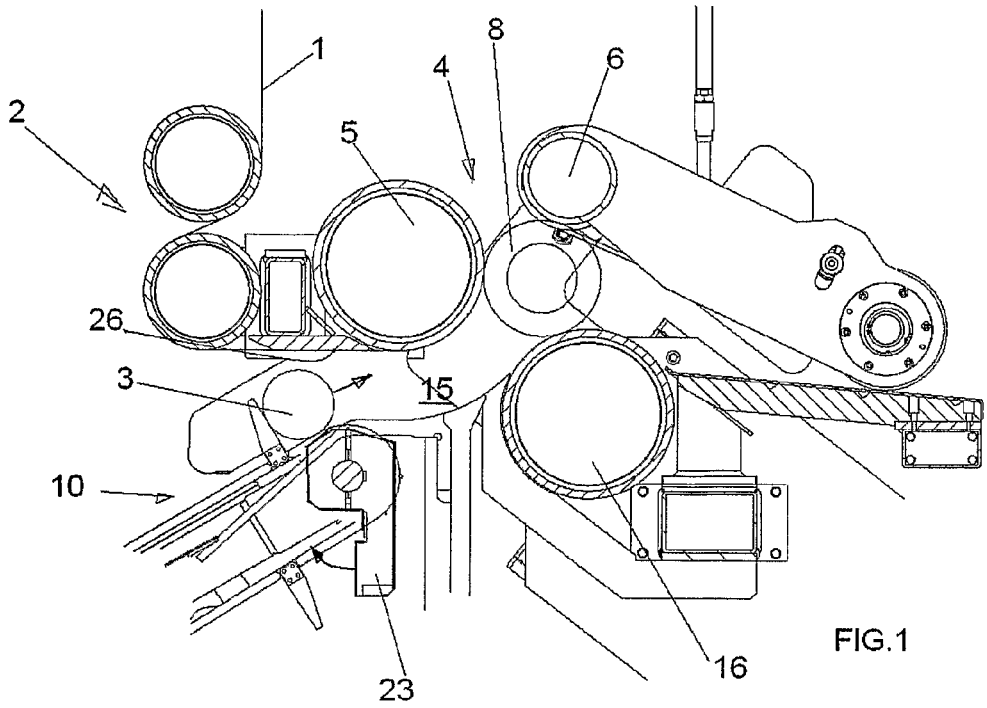
FIGS. 1-6 show the successive steps of the operation of reel exchange in the machine of FIG. 1A.

In FIG. 1 the machine is winding the log 8. When the log has attained the desired diameter or length of winding, the step of core exchange starts with the insertion of a new core 3 that is to be wound.

Figure 2:
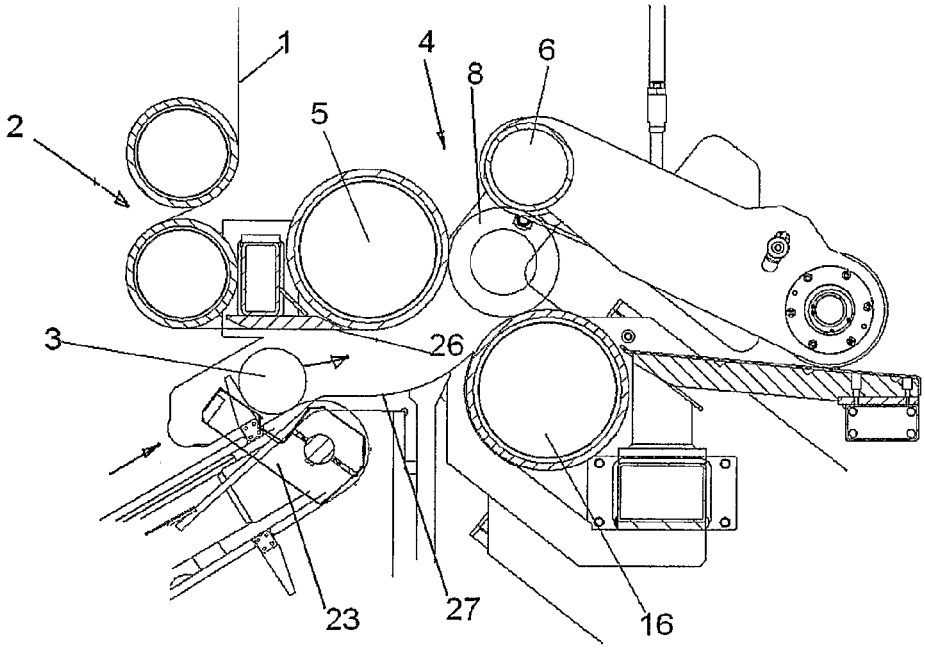

In FIG. 2, the step of core exchange is set under way, and a core pusher 23 starts to move turning about an axis 24 and comes into contact with the core 3 that is temporarily stationary having previously passed from the gluing assembly 22 where it has received the glue necessary to pick up the layer of paper and start the new winding.

Figure 3:
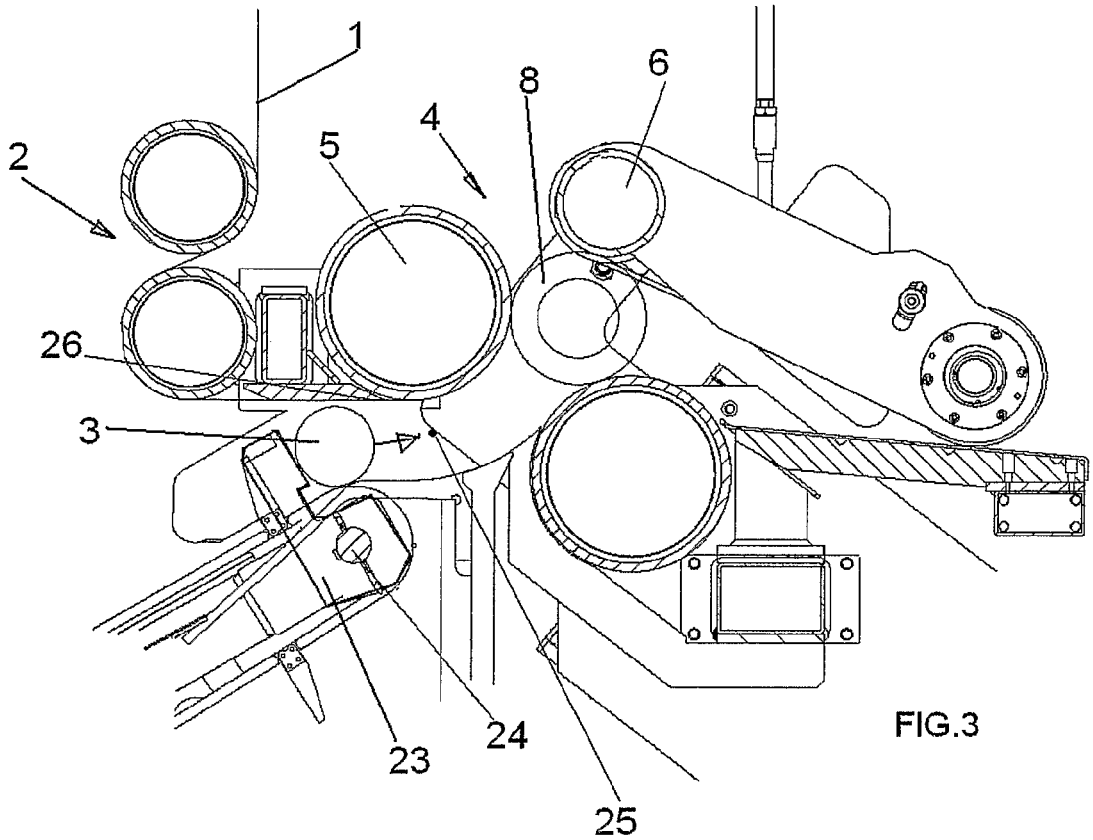

In FIG. 3, the core pusher 23 has received the core from the ramp 10 and is taking it to the point of exchange 25 in the channel 15. In this step, the speed that the pusher bestows on the core 3 is equal to or lower than the speed of the layer of paper 1 determined by the drawing assembly 2.

Figure 4:
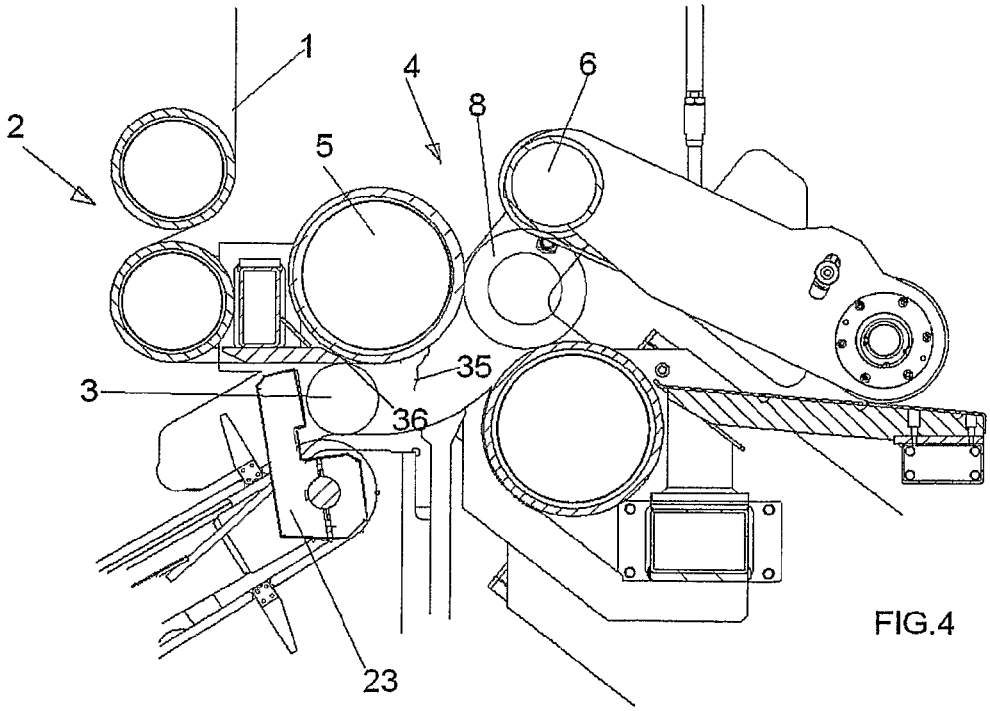

In FIG. 4, the core 3 pushed by the pusher 23 has reached the point of exchange 25. In this point a perforated line P is located in the stretch of the channel 15 between the core 3 that is entering and the top winding roller 5.

Advantageously, control of the position of the line P is performed by the control electronics on the basis of the signals sent by an encoder of the perforating assembly 9 so that it is possible to know constantly the position of the perforated lines made in the layer 1.

In this step, the new core 3 is set between a top pad 26 and the insertion guides 27 that delimit the channel 15, and the top winding roller 5 is accelerated with respect to the speed of the paper, which is kept by the drawing assembly 2 at a constant value.

As a result of the difference of speed, the layer 1 tears along the perforation P that is located between the core 3 and the top winding roller, and the leading free flap 35 of the layer 1 is recalled by the winding assembly, whilst the trailing free flap 36 remains glued on the core 3.

At the same moment, the pressure roller 6 and the bottom winding roller 16 change speed with respect to the constant speed of the paper and of the drawing assembly 2; namely, the bottom roller 16 slows down, and the pressure roller 6 accelerates, thus favouring expulsion of the finished log, whilst the flap of paper close to the core 3 is withheld thereon by the glue deposited by the gluing assembly 22.

Figure 5:
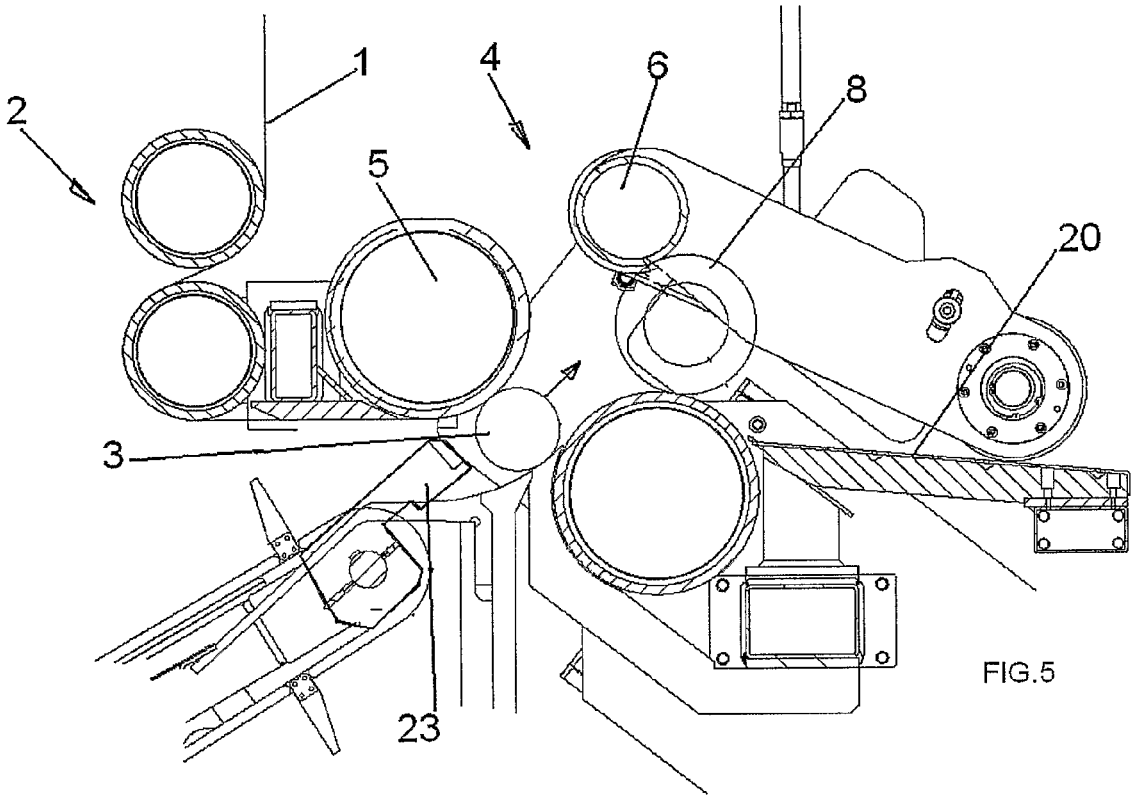

In FIG. 5, the core is carried by the pusher 23 into contact with the top winding roller 5, which gets it to roll on the insertion guides 27, thus starting winding of the new log 80.

The new log now passes between the top winding roller 5 and the bottom winding roller 16 as a result of the difference of speed of the two rollers.

The pusher 23 now goes back into the resting position continuing rotation in a clockwise direction up to the initial point.

Figure 6:
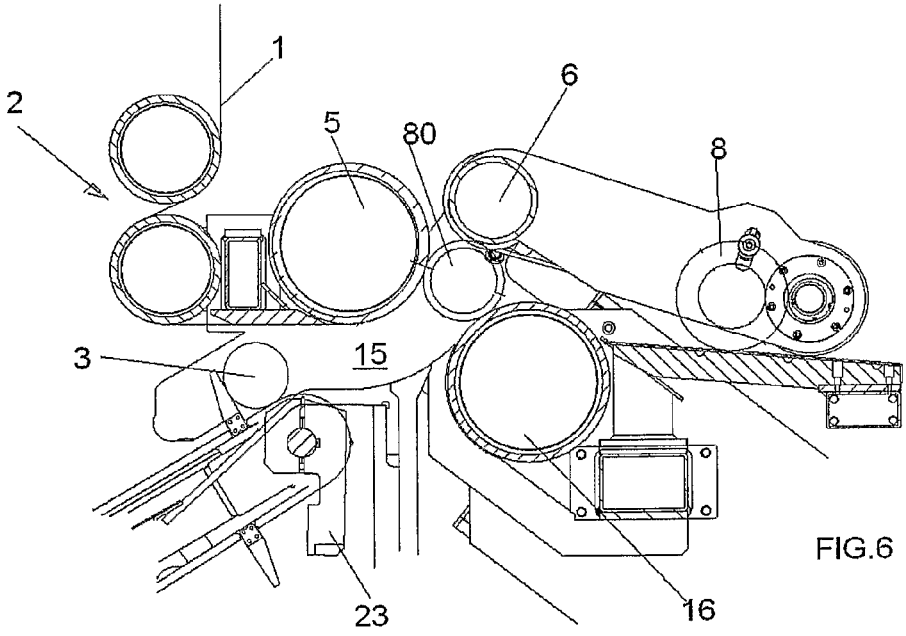

In FIG. 6, whilst the new log 80 is passing, as just described, between the two winding rollers 5, 16, the pressure roller 6 goes back into the lower position ready to receive the new log 80 and start to control a new winding process. Once the new log has passed between the top roller 5 and the bottom roller and is located in contact with the three winding rollers 5, 16, 6, the speed of the entire winding assembly 4 returns to that of the drawing assembly 2 for execution of a new winding cycle.

Figure 7:
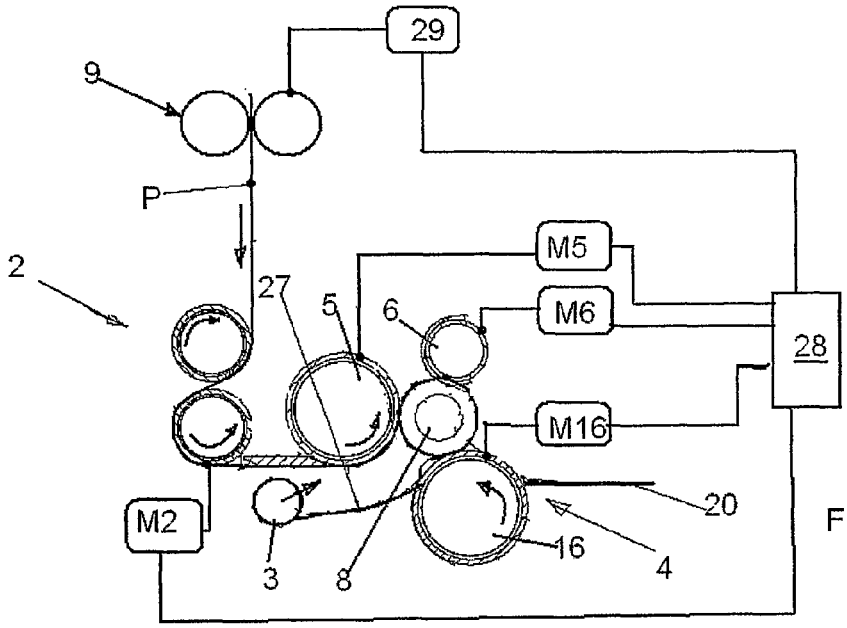
FIG. 7 is a schematic illustration of a winding machine with an apparatus according to the invention.

Illustrated schematically in FIG. 7 is an apparatus for exchange of cores according to the invention, where the rollers 5, 6, 16 of the winding assembly and the rollers of the drawing assembly are driven via respective motor drives M5, M6, M16 and M2, controlled by an electronic unit 28, which is also connected to the encoder 29 of the perforating assembly 9 in order to differentiate the speeds of the layer during winding with respect to the speed of the layer during drawing when the perforated line P is in the appropriate position and so bring about tearing of the layer 1 according to the method of the invention.

Preferably, in one embodiment of the invention, the motor drive M2 bestows a constant speed on the layer 1, whereas at least one of the motor drives M5, M6, M16 of the winding assembly can accelerate in a way independent of the motor drive M2 of the drawing assembly, for example the motor drive M5 of the top roller or the motor drive M6 of the pressure roller.

Figure 8:
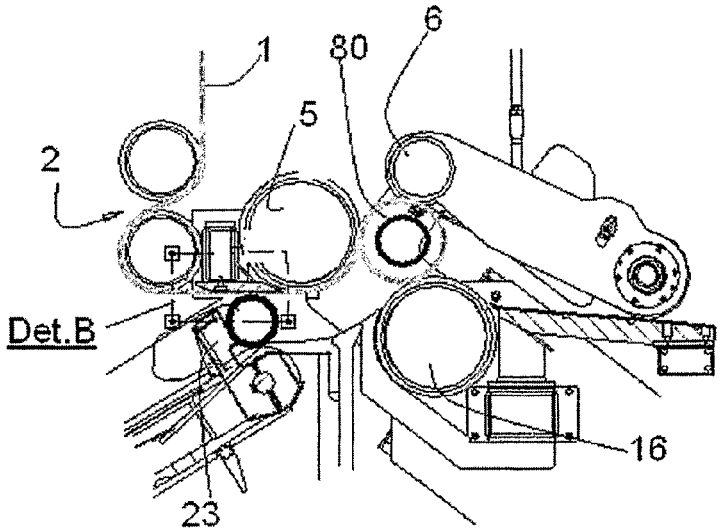
FIGS. 8 and 9 show a preferred embodiment of the invention.
Figure 8B:
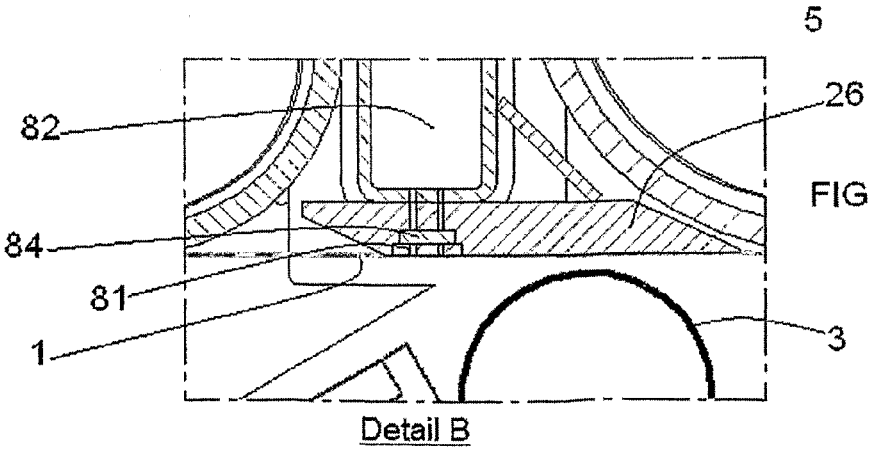
Figure 9:
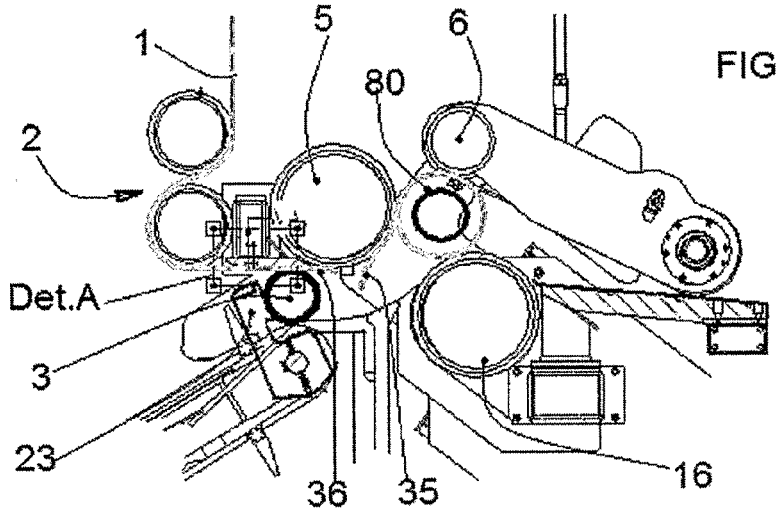
Figure 9A:
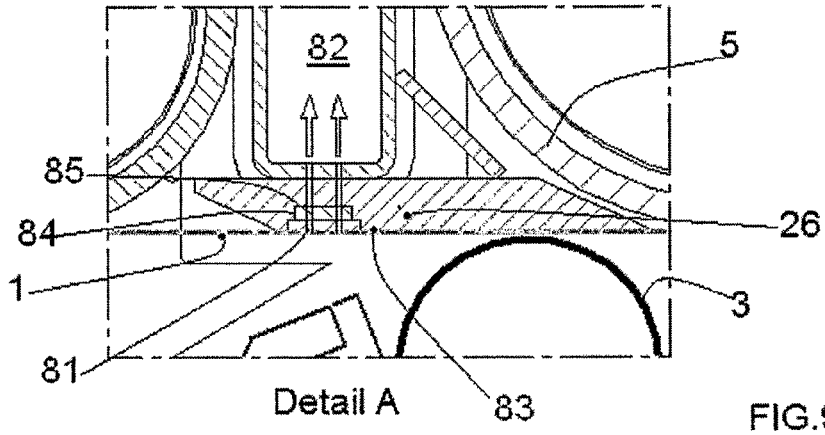

Illustrated with reference to FIGS. 8-10 is a preferred embodiment of the invention, where means are provided for suction of the layer of paper, which are set between said drawing assembly 2 and the winding assembly 4.

Preferably, these suction means are set immediately upstream of the channel 15, where the cores 3 that are to receive the initial flap of the layer 1 in the next winding cycle converge.

In the preferred embodiment just described, the suction means comprise a pad 26 traversed by a distribution of channels 81 communicating with a chamber in negative pressure 82 and with the bottom face 83 of the pad for sliding the layer of paper 1.

Figure 10A:
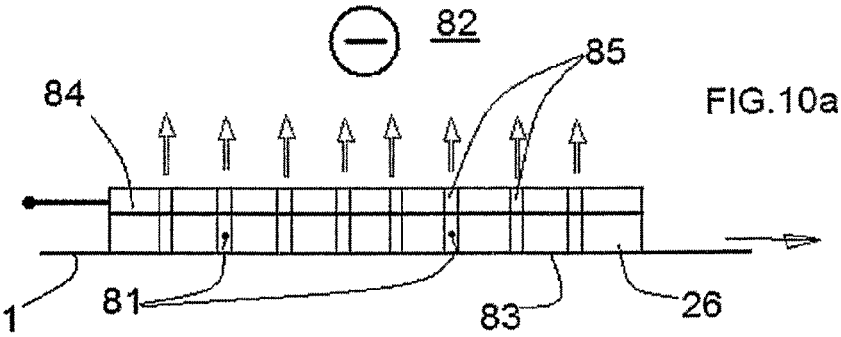
FIG. 10 shows a detail of the machine of FIGS. 8 and 9.
Figure 10B:
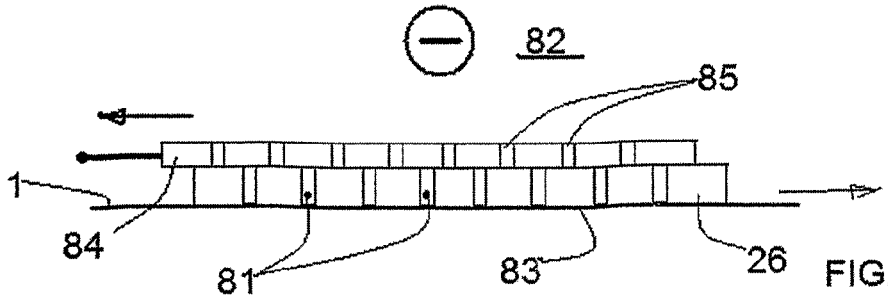

In the example illustrated schematically in FIGS. 10*a* and 10*b*, communication between the channels 81 and the negative-pressure chamber 82 is moreover opened/closed by an appropriate mechanism, for example a sliding shutter 84 provided with channels 85, which enable suction of the layer 1 when said channels 85 are set on top and coincide with the channels 81 of the pad 26 and prevent suction when they are staggered following upon a relative sliding with respect to the pad itself (FIG. 10*b*).

It is understood that an equivalent controlled shutoff system may in any case be used for enabling/disabling suction of the layer 1 during the winding cycle.

In particular, in operation the suction of the layer 1 is enabled, and hence the shutter 84 is brought into the suction position at the moment of separation of the layer of paper (FIG. 9, FIG. 10*a*) to facilitate interruption of the continuity of the layer, obtained as described above by means of a difference of speed between the winding assembly 4 and said drawing assembly 2.

Once the layer of paper has been torn, the shutter can be made to slide to disable suction (FIGS. 8 and 10*b*) and to enable start of a cycle of winding of the layer 1 onto the new core 3.

The present invention has been described according to preferred embodiments, but equivalent variant embodiments may be conceived, without thereby departing from the sphere of protection of the invention.

The invention claimed is:

1. A method for exchange of cores in a machine for winding a continuous layer of paper drawn by an assembly for drawing and feeding the layer and wound around a succession of cores by a winding assembly set downstream of said drawing assembly with respect to the direction of advance of the layer, the method comprising:

a step of interruption of the continuity of the layer, said interruption of the continuity of the layer being implemented by inducing a state of tension in the layer via a difference of speed of the layer between said winding assembly and said drawing assembly;

withholding the layer by suction between said winding assembly and said drawing assembly, said layer has transverse perforated lines; and detecting a position of one or more of said transverse perforated lines and controlling the difference of speed of the layer at the drawing assembly and at the winding assembly based on said detected position of one or more of said transverse perforated lines.

2. The method according to claim 1, wherein the drawing assembly is kept at a constant speed, and said difference of speed is obtained by acceleration of the winding assembly.

3. The method according to claim 1, wherein the winding assembly comprises a top winding roller, and said difference of speed is obtained by acceleration of the top winding roller.

4. The method according to claim 1, wherein the winding assembly comprises a pressure roller for drawing the layer of paper, and said difference of speed is obtained by acceleration of the pressure roller.

5. The method according to claim 1, wherein said state of tension is induced when a perforated line is located between said drawing assembly and said winding assembly.

6. The method according to claim 5, further comprising: controlling the position of the perforated line.

7. The method according to claim 1, further comprising: controlling the difference of speed of the layer at the drawing assembly and at the winding assembly.

8. The method according to claim 1, wherein said step of withholding starts immediately prior to said step of interruption of continuity of the layer.

9. The method according to claim 1, further comprising:

providing a suction device comprising a pad, a sliding shutter and a chamber, said pad comprising a plurality of pad channels, said sliding shutter comprising a plurality of sliding shutter channels, said chamber being arranged between a roller of said drawing assembly and a winding roller of said winding assembly;

activating said suction device such that a portion of said layer of paper is fixed to said pad between said drawing assembly and said winding assembly, each of said plurality of pad channels being in communication with one of said sliding shutter channels with said suction device in an activated state, wherein each of said plurality of pad channels is in communication with said chamber via said plurality of pad channels with said suction device in said activated state.

10. The method according to claim 9, wherein a surface of pad extends tangential to at least winding roller of said winding assembly.

11. The method according to claim 1, further comprising:

providing at least one drawing assembly motor;

providing at least one winding assembly motor;

controlling said drawing assembly via said at least one drawing assembly motor;

controlling said winding assembly via said at least one winding assembly motor, wherein said at least one drawing assembly motor is operated independently of said at least one winding assembly motor.

12. A method for exchange of cores, the method comprising:

providing a machine for winding a continuous layer of paper, said machine comprising a suction device, a drawing assembly and a winding assembly, said drawing assembly comprising a drawing assembly roller, said winding assembly comprising a winding assembly roller, said winding assembly being arranged downstream of said drawing assembly with respect to a direction of advance of the layer;

feeding the layer to said winding assembly via said drawing assembly and winding the layer about a succession of cores via at least said winding assembly;

separating said layer by producing a state of tension in the layer, wherein said suction device fixes at least portion of the layer between said drawing assembly and winding assembly and said drawing assembly roller operates at a speed that is different from a speed of said winding assembly roller to produce said tension in the layer, said layer having transverse perforated lines, and said state of tension being induced when a perforated line is located between said drawing assembly and said winding assembly, said layer having transverse perforated lines; and detecting a position of one or more of said transverse perforated lines and controlling the difference of speed of the layer at the drawing assembly and at the winding assembly based on said detected position of one or more of said transverse perforated lines, wherein said suction device comprises a pad, a sliding shutter and a chamber, said pad comprising a plurality of pad channels, said sliding shutter comprising a plurality of sliding shutter channels, said chamber being arranged between said drawing assembly roller and said winding assembly roller, each of said plurality of pad channels being in communication with one of said sliding shutter channels with said suction device in an activated state of said suction device, wherein each of said plurality of pad channels is in communication with said chamber via said plurality of pad channels with said suction device in said activated state of said suction device.

13. The method according to claim 12, wherein the drawing assembly is kept at a constant speed, and a difference of speed between said drawing assembly and said winding assembly is obtained by acceleration of the winding assembly.

14. A method for exchange of cores, the method comprising:

providing a machine for winding a continuous layer of paper, said machine comprising a suction device, a drawing assembly and a winding assembly, said suction device comprising an activated state, said drawing assembly comprising a drawing assembly roller, said winding assembly comprising a winding assembly roller, said winding assembly being arranged downstream of said drawing assembly with respect to a direction of advance of the layer;

feeding the layer to said winding assembly and winding the layer about a succession of cores via at least said winding assembly;

producing a state of tension in the layer by activating said suction device to said activated state and operating said winding assembly roller at a speed that is different from a speed of said drawing assembly roller, whereby the layer is separated via the tension produced in the layer, said suction device fixing a portion of the layer between said winding assembly and said drawing assembly in said activated state, said layer having transverse perforated lines; and detecting a position of one or more of said transverse perforated lines and controlling the difference of speed of the layer at the drawing assembly and at the winding assembly based on said detected position of one or more of said transverse perforated lines, wherein the layer is separated exclusively via the tension produced in the layer, said suction device comprising a pad, a sliding shutter and a chamber, said pad comprising a plurality of pad channels, said sliding shutter comprising a plurality of sliding shutter channels, said chamber being arranged between said drawing assembly roller and said winding assembly, each of said plurality of pad channels being in communication with one of said sliding shutter channels with said suction device in said activated state, wherein each of said plurality of pad channels is in communication with said chamber via said plurality of pad channels with said suction device in said activated state.

* * * * *